US011624571B1

(12) United States Patent
Kim et al.

(10) Patent No.: US 11,624,571 B1
(45) Date of Patent: Apr. 11, 2023

(54) FRAME ASSEMBLY FOR PISTOL WITH LOCK LEVER

(71) Applicant: DASAN MACHINERIES CO., LTD, Jeollabuk-do (KR)

(72) Inventors: Byung Hak Kim, Jeonju-si (KR); Jong Bum Kim, Jeonju-si (KR)

(73) Assignee: DASAN MACHINERIES CO., LTD, Jeollabuk-do (KR)

( * ) Notice: Subject to any disclaimer, the term of this patent is extended or adjusted under 35 U.S.C. 154(b) by 0 days.

(21) Appl. No.: 17/697,621

(22) Filed: Mar. 17, 2022

(51) Int. Cl.
*F41A 3/66* (2006.01)
*F41C 23/10* (2006.01)

(52) U.S. Cl.
CPC ..... *F41A 3/66* (2013.01); *F41C 23/10* (2013.01)

(58) Field of Classification Search
CPC ..... F41A 3/66; F41C 23/10
See application file for complete search history.

(56) References Cited

U.S. PATENT DOCUMENTS 5,655,326 A 8/1997 Levavi et al.
6,993,864 B1 2/2006 O'Clair et al.
8,156,677 B2 4/2012 Glock
11,143,473 B1 * 10/2021 Kim ..... F41A 3/66
2009/0071053 A1 3/2009 Thomele et al.
2014/0007479 A1 1/2014 Glock

FOREIGN PATENT DOCUMENTS

KR 10-1845051 B1 5/2018
WO WO-2020142761 A1 * 7/2020

* cited by examiner

*Primary Examiner* — Reginald S Tillman, Jr.
(74) *Attorney, Agent, or Firm* — Rabin & Berdo, P.C.

(57) ABSTRACT

A frame assembly for a pistol with a lock lever. The frame assembly includes a lower frame having a grip and an upper frame assembled on the lower frame and to a slide. The lower frame has: a mounting projection projecting upward to face the upper frame; and a lever mounting unit separated from the mounting projection and projecting upward. The upper frame has: a mounting groove into which the mounting projection is inserted to face the lower frame, and a lever hooking hole at one side of the mounting groove. The lever mounting unit has a lock lever having one end locked to be rotatable by a lock pin and the other end elastically supported to project upward. When the upper frame is assembled to the lower frame, the other end of the lock lever is inserted into the lever hooking hole and the upper frame is locked.

8 Claims, 11 Drawing Sheets

FRAME ASSEMBLY FOR PISTOL WITH LOCK LEVER

BACKGROUND OF THE INVENTION

Field of the Invention

The present invention relates to a frame assembly for a pistol with a lock lever, and more specifically, to a frame assembly for a pistol with a lock lever, the frame assembly having a structure improved to enable a grip part (hereinafter, referred to as a "lower frame") and a rail (hereinafter, referred to as an "upper frame"), to which a slide is joined, to be easily and strongly assembled together.

Description of the Related Art

In general, a frame assembly for a pistol is integrally formed integrally with a rail on which a slide is assembled. However, in this case, there is a problem that the entire frame for pistol must be replaced unnecessarily when damages to the rail part occurs frequently.

In order to solve this problem, the applicant has developed a frame assembly for pistol (Korean Patent Registration No. 10-1845051, a frame for a reinforced plastic pistol with a metal rail having an improved structure, hereinafter referred to as a 'Patent Literature') which can easily separate and replace only the damaged rail part if necessary. In addition, if necessary, a handle part of the frame for pistol is made of a light plastic material and a rail part is made of a material with high rigidity such as a metal, so that they are mutually assembled to each other.

The frame for pistol disclosed in the Patent Literature includes a lower frame made of a reinforced plastic material and having a handle formed at its lower portion; and an upper frame assembled onto the lower frame while being assembled to the slide and made of a metal material, wherein the lower frame includes a first support positioned in front of the handle to support a bottom surface of the upper frame, and a second support positioned behind the handle to support a rear surface of the upper frame; and the upper frame is assembled to the lower frame such that the bottom and rear surfaces of the upper frame are supported by the first and second supports, and the upper frame has a front rail and a rear rail that are integrally formed on its upper surface, the front and rear rails being assembled to the slide.

In the frame for pistol of the Patent Literature, the fixing pin and the assembly screw penetrate the side of the lower frame to fix the upper frame. However, in this case, since the fixing pin and the assembly screw are exposed to the outside as it is, there is a risk of contamination or corrosion by the external environment.

Accordingly, there is a need to develop a frame assembly for pistol with an improved structure in order that the lower frame and the upper frame can be easily and strongly assembled, the assembly screw etc. is not exposed to the outside, and the lower frame and the upper frame are not easily and arbitrarily separated.

PATENT LITERATURE

Patent Literature 1: KR 10-1845051 B1 (Mar. 28, 2018)
Patent Literature 2: U.S. Pat. No. 5,655,326 B1 (Aug. 12, 1997)
Patent Literature 3: U.S. Pat. No. 6,993,864 B1 (Feb. 7, 2006)

Patent Literature 4: U.S. Pat. No. 8,156,677 B2 (Apr. 17, 2012)
Patent Literature 5: US 2014-0007479 A1 (Jan. 9, 2014)
Patent Literature 6: US 2009-0071053 A1 (Mar. 19, 2009)

SUMMARY OF THE INVENTION

The invention is made to solve the problems of a frame assembly for a pistol in the related art described above, and an object of the invention is to provide a frame assembly for a pistol with a lock lever in which a lower frame and an upper frame can be strongly assembled together, and a screw for assembling the upper and lower frames is not to be exposed outside, thus being inhibited from loss or damage such as corrosion.

Further, another object thereof is to provide a frame assembly for a pistol with a lock lever in which grip panels assembled on both side surfaces of a lower frame can be easily and strongly assembled without using a separate assembly screw.

Furthermore, still another object thereof is to provide a frame assembly for a pistol with a lock lever in which a single type or a double type of lower frame and an upper frame of 4.25 in., 5 in., or 6 in. can be variously assembled to each other.

According to an aspect of the invention to achieve the object described above, there is provided a frame assembly for a pistol with a lock lever, the frame assembly including: a lower frame having a grip formed at a lower side; and an upper frame that is assembled on the lower frame and is assembled to a slide, wherein the lower frame has: a mounting projection which has a predetermined length and projects upward to a predetermined height in a direction to face the upper frame; and a lever mounting unit formed to be separated by a predetermined distance in a horizontal direction from the mounting projection and project upward to a predetermined height, wherein the upper frame has: a mounting groove which has a predetermined depth and into which the mounting projection is inserted in a direction to face the lower frame, and a lever hooking hole which has a predetermined depth at one side of the mounting groove, and wherein the lever mounting unit has a lock lever having one end that is locked to be rotatable by a lock pin and the other end that is elastically supported to project upward by an elastic spring, and when the upper frame is assembled to the lower frame, the other end of the lock lever is inserted into the lever hooking hole and the upper frame is locked.

In addition, the lower frame and the upper frame are screw-assembled by fastening a coupling screw from an inner side of the upper frame toward the lower frame.

In addition, the mounting projection has fitting grooves which have a predetermined depth and are formed along both side surfaces in a length direction of the mounting projection, and wherein the mounting groove has hook projections which project by a predetermined width and are formed along both side surfaces in a length direction of the mounting groove so as to be fitting-inserted into the fitting groove.

In addition, the grip has mounting portions which have a predetermined depth at both side surfaces along a vertical length of the grip, and wherein the mounting portion has a pair of grip panels which are provided to be slid and fitting-assembled in a vertical direction.

In addition, the lower frame is manufactured in a single type or a double type depending on a size of a magazine which can be mounted inside the lower frame, wherein the upper frame is manufactured to have a size of 4.25 in., 5 in., and 6 in. depending on a length of a gun barrel, and wherein the lower frame as any one selected from the single type and the double type and the upper frame as any one selected from upper frames of 4.25 in. 5 in. and 6 in. are configured to be assembled together.

BRIEF DESCRIPTION OF THE DRAWINGS

The above and other objects, features and advantages of the present invention will be more apparent from the following detailed description taken in conconfluence with the accompanying drawings, in which.

DETAILED DESCRIPTION OF THE PREFERRED EMBODIMENT

Hereinafter, the preferred embodiment of the invention will be described in detail with reference to the accompanying drawings.

Figure 1:
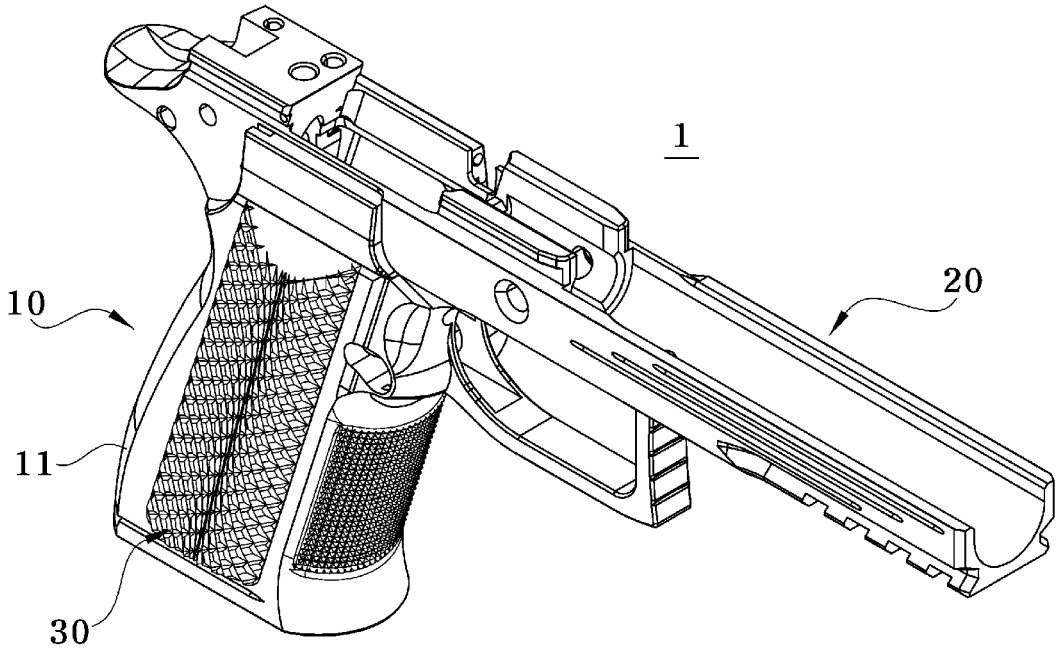
FIG. 1 is a perspective view illustrating an example of a frame assembly for a pistol with a lock lever according to the invention.
Figure 2:
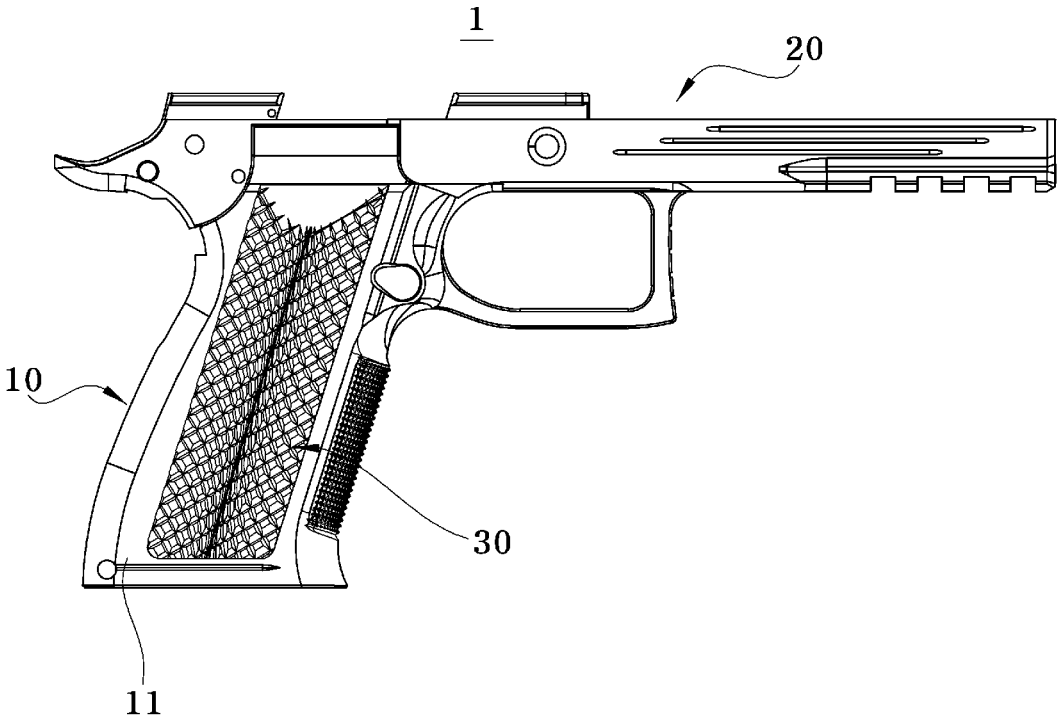
FIG. 2 is a side view of FIG. 1.
Figure 3:
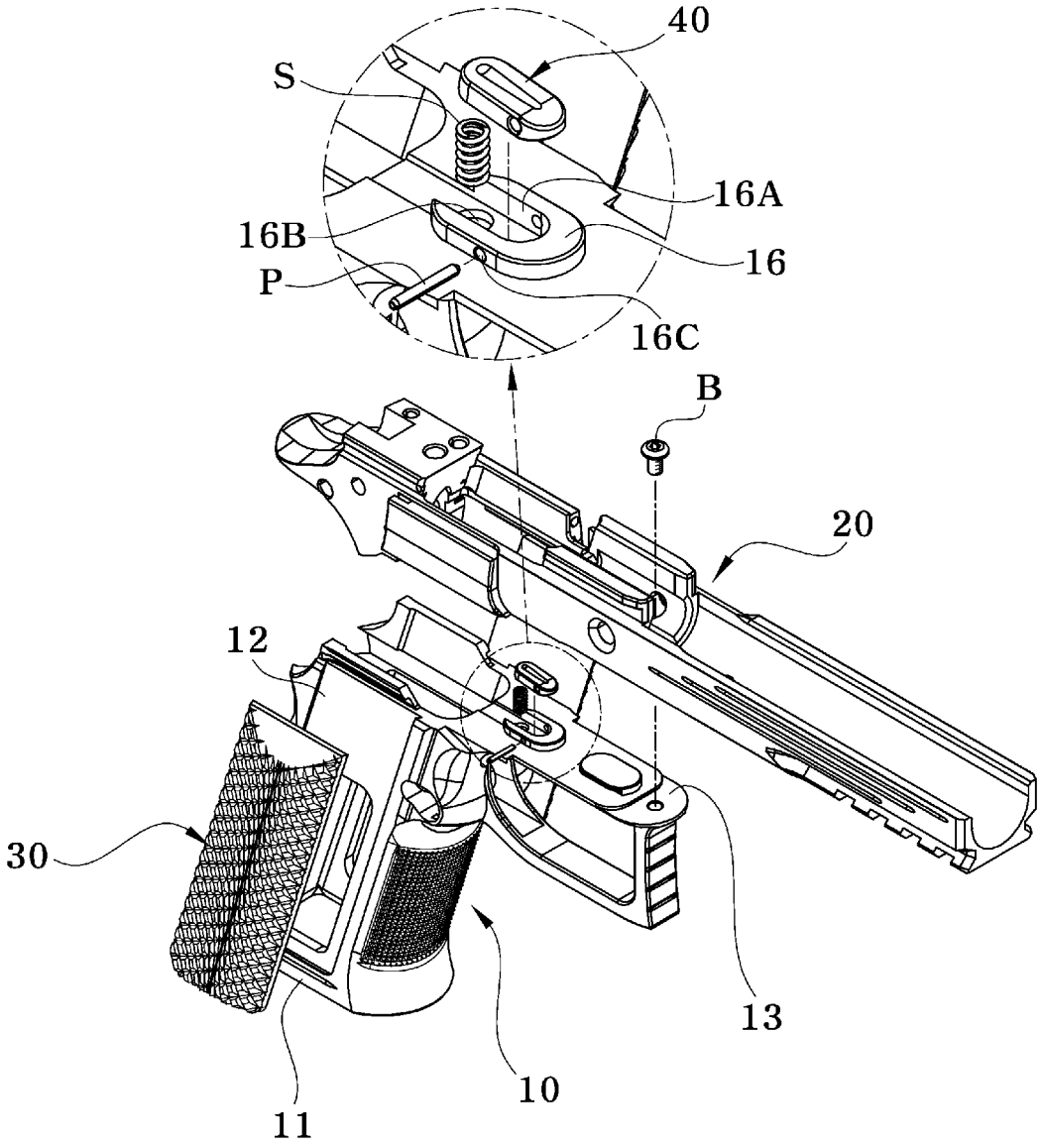
FIG. 3 is an exploded perspective view of FIG. 1.

According to the invention, there is provided a frame assembly for a pistol with a lock lever in which a lower frame and an upper frame can be strongly assembled together and a screw for assembling the upper and lower frames is not exposed outside so as to prevent loss or damage such as corrosion. In the invention, the frame assembly includes a lower frame (10) and an upper frame (20) as illustrated in FIGS. 1 and 2.

Hereinafter, for convenience of description, a side to which a muzzle of a pistol points is referred to as a 'front side', and an opposite side thereof is referred to as a 'rear side'.

The lower frame (10) has a configuration for a user to grip a pistol and manipulate a trigger (not illustrated).

Figure 4:
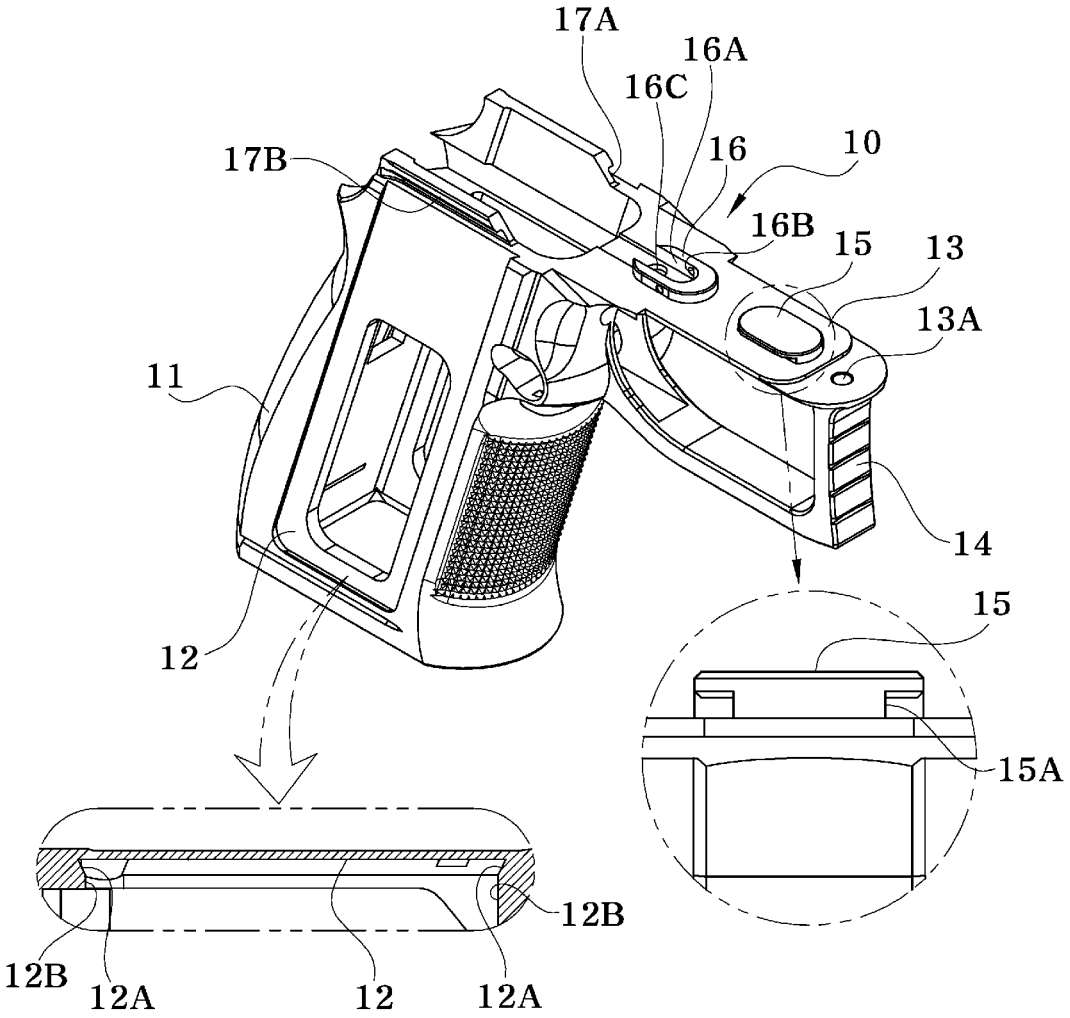
FIGS. 4 and 5 are perspective views illustrating an example of a lower frame according to the invention.
Figure 5:
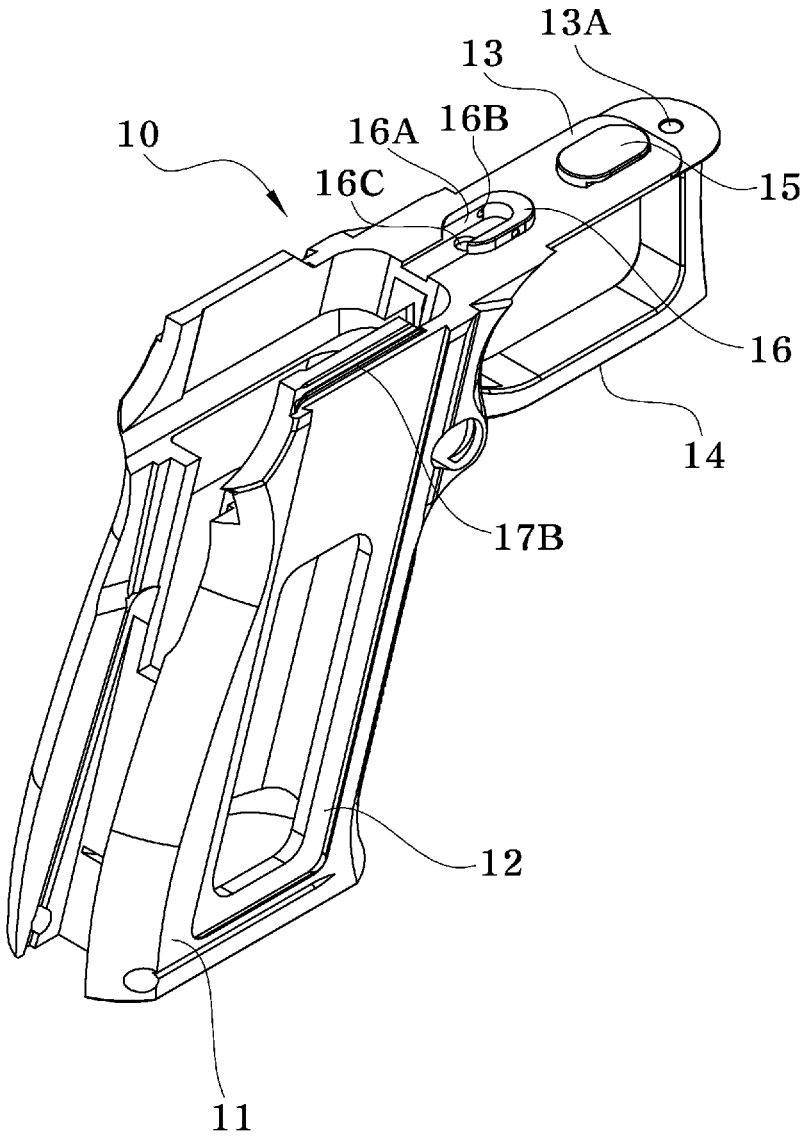

The lower frame (10) includes a grip part (11) having a predetermined size which is formed to have a predetermined length vertically such that a user grips the grip part as illustrated in FIGS. 4 and 5, mounting portions (12) having a predetermined depth which are formed at both side surfaces of the grip part (11), a seating portion (13) having a predetermined width which is extended horizontally along an upper end of the grip part (11) by a predetermined length and projects, a trigger guide (14) which is formed at a bottom of the seating portion (13) and by which the trigger is exposed inside, a mounting projection (15) having a predetermined length which is provided at a top surface of the seating portion (13) and projects upward to a predetermined height in a direction to face the upper frame (20) to be described below, and a lever mounting unit (16) which is formed to be separated by a predetermined distance in a horizontal direction from the mounting projection (15) and on which the lock lever (40) is mounted.

Here, the grip part (11) is manufactured as a single type and a double type depending on a type of magazine which is inserted into a bottom of the grip part (11), and any one selected from the single type and double type lower frames (10) is assembled to the upper frame (20) to be described below.

Besides, as illustrated in FIGS. 4 and 5, the mounting portions (12) are formed to have a predetermined depth at both side surfaces of the grip part (11), and a top surface of the mounting portion is opened to communicate with a top surface of the lower frame (10).

Further, as illustrated in FIG. 4, the mounting portion (12) has inclined surfaces (12A) which face each other at both side surfaces in a vertical length direction and are inclined at an angle of 30° to 70° and vertical surfaces (12B) which are integrally formed at ends of the inclined surfaces (12A) to be extended by a predetermined length and project to be substantially perpendicular to the mounting portion (12).

A configuration of the mounting portion (12) described above allows grip panels (30), which will be described below, to be assembled or disassembled by sliding in a vertical direction through the opened top surface of the mounting portion (12).

The seating portion (13) further has a screwing hole (13A) having a predetermined diameter, and a coupling screw (B) is fastened into the screwing hole (13A) of the seating portion (13), the screw being fastened from an inner side of the upper frame (20), which will be described below, in a state where the upper frame (20) is assembled.

Further, the mounting projection (15) is formed to have a predetermined length in a front-rear direction and has fitting grooves (15A) which are formed to have a predetermined depth at both side surfaces in a length direction of the mounting projection (15) as illustrated in FIG. 4. In this configuration, the upper frame (20) is to slide through the fitting grooves (15A) by a predetermined length in a horizontal direction such that hook projections at both sides of a mounting groove (25) to be described below are inserted into the fitting grooves (15A). This configuration causes the lower frame (10) and the upper frame (20) to be more strongly coupled to each other and are maintained in such a coupled state.

Further, the lever mounting unit (16) is formed by a "U"-shaped projection having the top surface and one side (rear side) open, and the lever mounting unit has a mounting groove (16A) therein which has a predetermined size and into which the lock lever (40) to be described below is inserted, a pin coupling hole (16B) which has a predetermined diameter so as to penetrate one side of the mounting groove (16A), and a spring locking groove (16C) which is formed to have a predetermined depth and a predetermined diameter in a bottom surface at the other side of the mounting groove (16A).

An upper end (one end at a rear side) of the lower frame (10) further has a pair of locking grooves (17A and 17B) that has a predetermined length in a horizontal direction and faces each other symmetrically as illustrated in FIGS. 4 and 5, and locking projections (with no reference sign) at a bottom of the upper frame (20) to be described below slide to be inserted into the pair of locking grooves (17A and 17B) such that the rear sides of the lower frame (10) and the upper frame (20) are more strongly coupled to each other.

The upper frame (20) is configured to be assembled on the lower frame and is combined with a slide (not illustrated) which moves by sliding.

Figure 6:
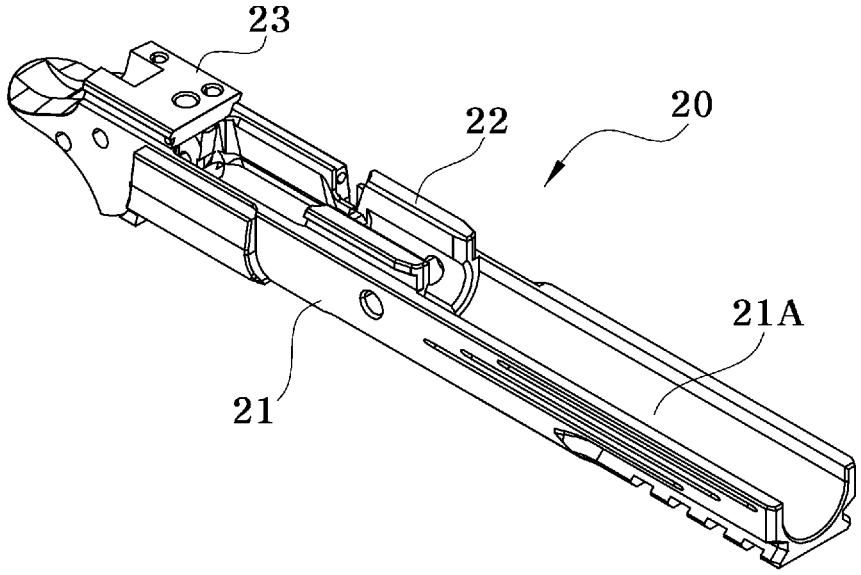
FIGS. 6 and 7 are perspective views illustrating an example of an upper frame according to the invention.
Figure 7:
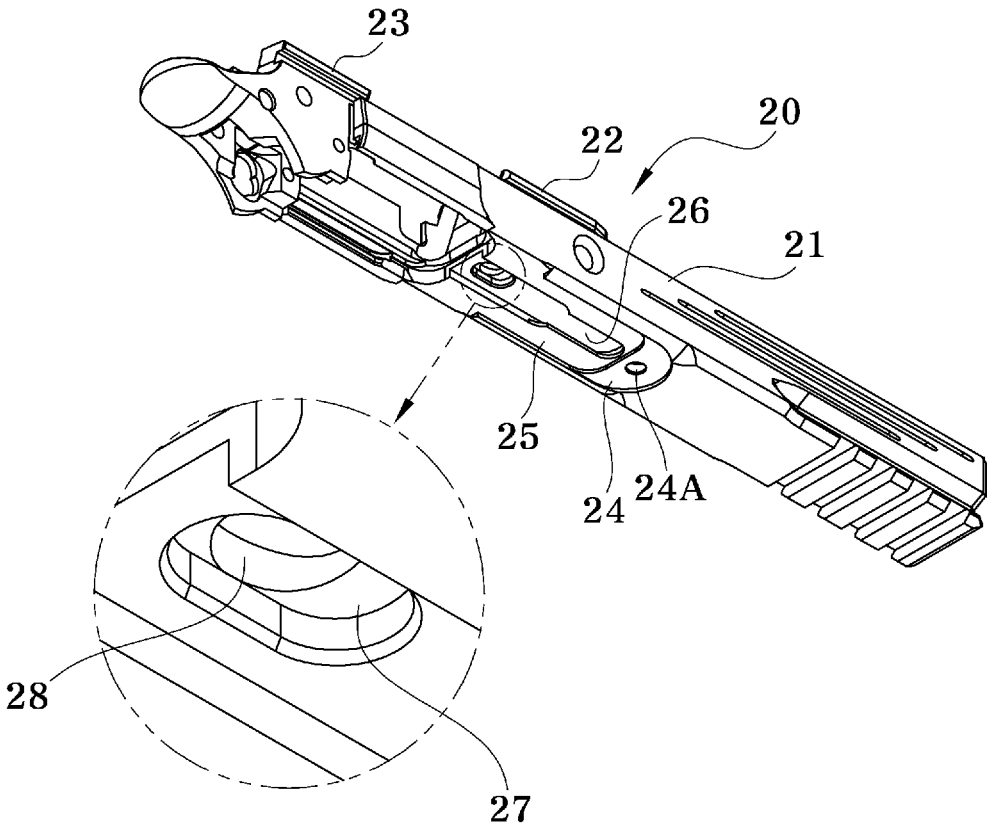

The upper frame (20) includes a main frame body (21) which is manufactured to have a length of gun barrel of 4.25 in., 5 in., and 6 in. and, as illustrated in FIGS. 6 and 7, has a predetermined length horizontally, a front rail (22) which is positioned at a central portion of a top surface of the main frame body (21) and is formed to project so as to be assembled to the slide, a rear rail (23) which is positioned at a rear side of the upper surface of the main frame body (21) and is formed to project so as to be assembled to the slide, a mounting groove (25) having a predetermined depth which is positioned at a bottom of the main frame body (21) to come into surface contact with the seating portion (13) of the lower frame (10), and a coupling groove (26) having a predetermined depth which is formed to have a predetermined length in the front-rear direction at a central portion of the mounting groove (25) so that the mounting projection (15) is slid and inserted to be fitting-coupled.

Here, the main frame body (21) has a loading spring installing groove (21A) having a predetermined diameter at a front side of the top surface of the main frame body.

The main frame body (21) further has a through-hole (24A) having a predetermined diameter which penetrates upper and lower surfaces to be coincident with a position of the screwing hole (13A) of the lower frame (10) as illustrated in FIG. 7.

Further, the mounting groove (25) has a contact surface portion (24) having a predetermined width at one end (at the front side), the contact surface portion having a step which is formed to relatively more project than the mounting groove (25), and an end at the front side of the seating portion (13) of the lower frame (10) is allowed to come into close contact with the mounting groove through the contact surface portion (24).

One side (at the rear side) of the coupling groove (26) is opened to allow the mounting projection (15) to be sliding-inserted and fitting-locked thereinto, and the coupling groove (26) is simultaneously formed to have an inverted "T"-shaped cross section. Hence, the mounting projection (15) is positioned through the opened one side (at the rear side) of the coupling groove (26) and then is easily fitting-assembled by being slid toward the other side surface (at the front side) by a predetermined length.

Further, the coupling groove (26) has a lever hooking hole (27) formed to have a predetermined size at the opened one side as illustrated in FIG. 7. Hence, when the lower frame (10) and the upper frame (20) are assembled together, the lock lever (40) provided at the lower frame (10) is inserted into the lever hooking hole (27) to be locked to a position thereof, and the mounting projection (15) is naturally maintained in a fitting-assembled state into the coupling groove (26). As a result, the lower frame (10) and the upper frame (20) are not randomly disassembled even though the coupling screw (B) which is fastened by penetrating the lower and upper frames in order is not assembled.

Meanwhile, an unlocking hole (28) which has a predetermined diameter is formed through the lever hooking hole (27), and the lock lever (40) is configured to be pressed and unhooked from an inner side of the upper frame (20) through the unhooking hole (28) as necessary.

In addition, the main frame body (21) has a pair of locking projections (with no reference sign) which projects from both lower side surfaces at the rear side of the main frame body by a predetermined width in a direction facing each other. The upper frame (20) is slid in the horizontal direction, and thereby the pair of locking projections are inserted into the locking grooves (17A and 17B) of the lower frame (10) such that the rear side of the main frame body (21) is locked.

According to such a configuration described above, the bottom of the upper frame (20) is seated to come into close contact with the seating portion (13) of the lower frame (10) and then is slid and moved rearward by a predetermined length such that the mounting projection (15) is inserted into the mounting groove (26), and simultaneously the locking projections of the upper frame (20) are inserted into the locking grooves (17A and 17B) of the lower frame (10). Further, the lock lever (40) provided at the lower frame (10) is inserted into the lever hooking hole (27) of the upper frame (20) to be hooked and locked, and thereby the lower frame (10) and the upper frame (20) are structurally inhibited from sliding. As a result, the lower frame (10) and the upper frame (20) are maintained in a strongly assembled state only by being sliding-assembled together.

In a state where the lower frame (10) and the upper frame (20) are assembled together, the coupling screw (B) is assembled to penetrate a through-hole (24A) and the screwing hole (15A) in this order from an inner side of the upper frame (20), and thereby the lower frame (10) and the upper frame (20) are more strongly assembled together. Then, the slide (not illustrated) is coupled to the upper frame (20), and thereby the coupling screw (B) and the unhooking hole (28) positioned at the inner side of the upper frame (20) are covered not to be exposed outside.

Figure 8:
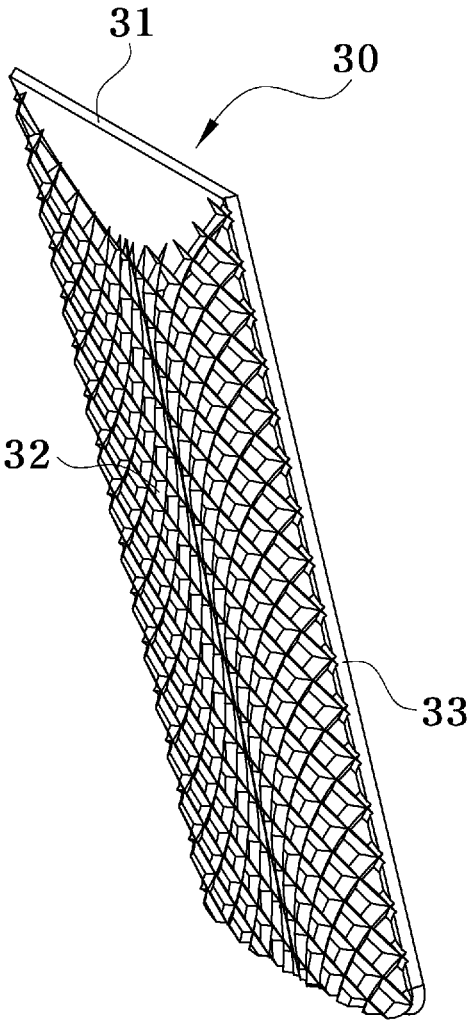
FIGS. 8 and 9 are views illustrating an example of a grip panel according to the invention.
Figure 9:
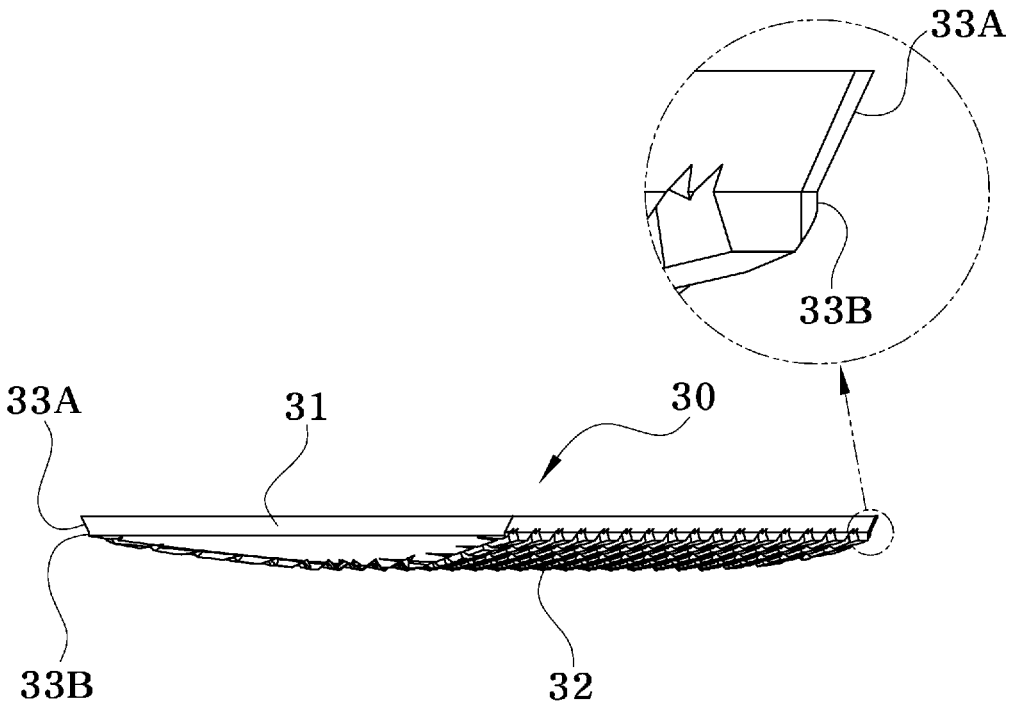

Meanwhile, the grip panels (30) which are vertically sliding-assembled at the mounting portion (12) of the lower frame (10) includes a main panel body (31) which has a flat surface at one side facing the mounting portion (12) as illustrated in FIGS. 8 and 9 and a surface having an arc shape with a predetermined diameter at the other side with which a hand of a user comes into contact unlike the flat surface, a grip forming portion (32) formed to have a plurality of grooves and projections on the surface at the other side of the main panel body (31), and slide combining portions (33) which are formed along both side surfaces of the main panel body (31).

Besides, the slide combining portion (33) has an inclined surface (33A) at a predetermined angle and a perpendicular surface (33B) having a predetermined width, in which the inclined surface (33A) corresponds to the inclined surface (12A) of the mounting portion (12), and the perpendicular surface (33B) corresponds to the perpendicular surface (12B) of the mounting portion (12). The grip panel (30) can be easily assembled only by sliding and inserting the grip panel (30) in a downward direction from above of the mounting portion (12) when the grip panel (30) is assembled to the lower frame (10) through the slide combining portion (33). At the same time, the inclined surfaces (12A and 33A) and the perpendicular surfaces (12B and 33B) of the mounting portion (12) and the slide combining portion (33) come into close contact with each other, and thus the grip panel (30) does not move separately.

The pair of grip panels (30) is assembled to mounting portions (12) at both sides of the lower frame (10) before the upper frame (20) is assembled to the lower frame (10). The upper frame (20) is seated to be assembled to the seating portion (13) of the lower frame (10) such that the opened top surface of the mounting portions (12) of the lower frame (10) is covered with the upper frame (20). Hence, the grip panels (30) are structurally inhibited from being randomly detached from the positions thereof even when the grip panels are not assembled to the grip part (11) with a separate screw or the like.

Figure 10A:
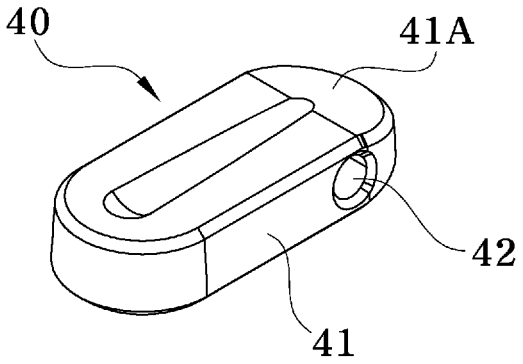
FIGS. 10A and 10B are perspective views illustrating an example of a lock lever according to the invention.
Figure 10B:
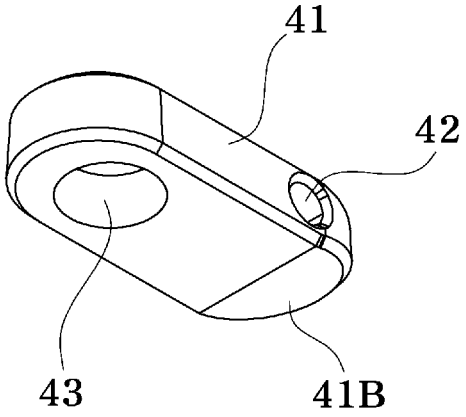

Meanwhile, as illustrated in FIGS. 10A and 10B, the lock lever (40) assembled to the lever mounting unit (16) of the lower frame (10) has a main lever body (41) formed to have a block shape having a predetermined size, a pin penetrating hole (42) which has a predetermined diameter and is formed to penetrate both side surfaces at one end of the main lever body (41), and a spring locking groove (43) which has a predetermined diameter and is formed at a bottom at the other end of the main lever body (41).

Figure 11:
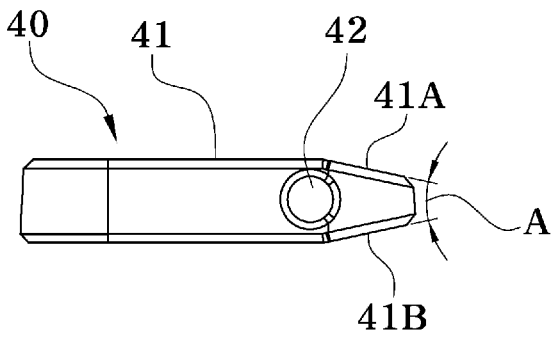
FIG. 11 is a side view illustrating the example of the lock lever according to the invention.
Figure 12:
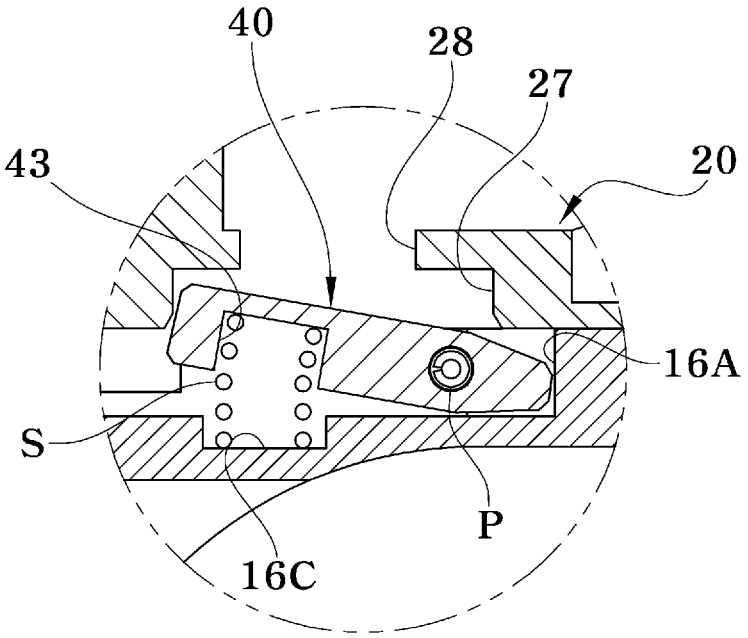
FIG. 12 is a view illustrating an example in which the upper and lower frames are coupling-locked by the lock lever according to the invention.

In addition, as illustrated in FIGS. 11 and 12, the main lever body (41) has upper and lower inclined surfaces (41A and 41B) having a predetermined inclined angle (A) at upper and lower surfaces at one end of the main lever body (41) such that a free end of the main lever body (41) maintains an upward projecting state at a predetermined angle by an elastic spring (S).

In this case, the elastic spring (S) is locked by positioning upper and lower ends thereof through the spring locking groove (16C) of the lever mounting unit (16) and the spring locking groove (43) of the lock lever (40), and thus the elastic spring (S) is not randomly detached from the position thereof even by pressing movement of the lock lever (40).

The configuration described above allows the upper frame (20) to be slid and assembled during the assembling of the lower frame (10) and the upper frame (20), and thus the free end of the lock lever (40) is inserted into a side of the lever hooking hole (27). In this manner, the upper frame (20) is inhibited from additional sliding, and thus the assembled state is maintained.

In addition, when the lower frame (10) and the upper frame (20) are disassembled, the free end of the lock lever (40) is pressed through the unhooking hole (28) to unhook the free end of the lock lever (40) from the lever hooking hole (27), and thereby the upper frame (20) can be slid. Then, the upper frame (20) is slid by a predetermined length in an opposite direction of an assembling direction, thereby being disassembled from the lower frame.

Meanwhile, in the above-provided illustration and description, the free end of the lock lever (40) which is elastically supported to project upward is positioned at the rear side of the lock lever (40), and a lock end which is hinge-coupled through a lock pin (P) is positioned at the front side. Conversely, the configuration can be modified such that the free end of the lock lever (40) which is elastically supported to project upward is positioned at the front side of the lock lever (40), and the lock end which is hinge-coupled through the lock pin (P) is positioned at the rear side.

As described above, the upper frame provided on the lower frame is fitting-assembled together by sliding and moving horizontally by a predetermined length due to a structure of the mounting projection and the mounting groove. Through this process, the lock lever provided in the lever mounting unit of the lower frame is elastically inserted into the lever hooking hole of the upper frame to be hook-locked. In this state, the coupling screw is fastened from the inner side of the upper frame toward the lower frame such that the upper and lower frames are combined with each other. Hence, the lower frame and the upper frame can be strongly coupled to each other without exposing the screw outside the frame assembly.

Further, the lower frame can be manufactured in the single type or the double type depending on a type of magazine which is mounted in the lower frame, the upper frame can be manufactured to have a size of 4.25 in., 5 in., and 6 in. depending on a length of a gun barrel, and thus the lower frame and the upper frame can be selectively assembled together to form various combinations as necessary.

In addition, the following advantage is obtained. The pair of grip panels is combined by sliding in a downward direction from above at both sides of the lower frame, and in this state, the upper frame is combined to the lower frame. Thus the grip panels can be easily fixed without using a separate fastening member such as a screw.

In the above, for the convenience of explanation, the drawings showing the preferred embodiments and the configurations shown in the drawings have been described with reference numerals and names. However, as an embodiment according to the present invention, the scope of the invention should not be interpreted as it is limited to the shapes shown in the drawings and the names given. While the present invention has been described with respect to the specific embodiments, it will be apparent to those skilled in the art that various changes and modifications may be made without departing from the spirit and scope of the invention as defined in the following claims.

What is claimed is:

1. A frame assembly for a pistol with a lock lever, the frame assembly (1) comprising:

a lower frame (10) having a grip (11) formed at a lower side; and an upper frame (20) that is assembled on the lower frame (10) and is assembled to a slide, wherein the lower frame (10) has:

a mounting projection (15) which has a predetermined length and projects upward to a predetermined height in a direction to face the upper frame (20); and a lever mounting unit (16) formed to be separated by a predetermined distance in a horizontal direction from the mounting projection (15) and project upward to a predetermined height, wherein the upper frame (20) has:

a mounting groove (25) which has a predetermined depth and into which the mounting projection (15) is inserted in a direction to face the lower frame (10), and a lever hooking hole (27) which has a predetermined depth at one side of the mounting groove (25), and wherein the lever mounting unit (16) has a lock lever (40) having one end that is locked to be rotatable by a lock pin (P) and the other end that is elastically supported to project upward by an elastic spring (S), and when the upper frame (20) is assembled to the lower frame (10), the other end of the lock lever (40) is inserted into the lever hooking hole (27) and the upper frame (20) is locked.

2. The frame assembly for a pistol with a lock lever according to claim 1, wherein the lower frame (10) and the upper frame (20) are screw-assembled by fastening a coupling screw (B) from an inner side of the upper frame (20) toward the lower frame (10).

3. The frame assembly for a pistol with a lock lever according to claim 1, wherein the mounting projection (15) has fitting grooves (15A) which have a predetermined depth and are formed along both side surfaces in a length direction of the mounting projection, and wherein the mounting groove (25) has hook projections which project by a predetermined width and are formed along both side surfaces in a length direction of the mounting groove so as to be fitting-inserted into the fitting groove (15A).

4. The frame assembly for a pistol with a lock lever according to claim 1, wherein the grip (11) has mounting portions (12) which have a predetermined depth at both side surfaces along a vertical length of the grip, and wherein the mounting portion (12) has a pair of grip panels (30) which are provided to be slid and fitting-assembled in a vertical direction.

5. The frame assembly for a pistol with a lock lever according to claim 1, wherein the lower frame (10) is manufactured in a single type or a double type depending on a size of a magazine which can be mounted inside the lower frame, wherein the upper frame (20) is manufactured to have a size of 4.25 in., 5 in., and 6 in. depending on a length of a gun barrel, and wherein the lower frame (10) as any one selected from the single type and the double type and the upper frame (20) as any one selected from upper frames of 4.25 in. 5 in. and 6 in. are configured to be assembled together.

6. The frame assembly for a pistol with a lock lever according to claim 2, wherein the mounting projection (15) has fitting grooves (15A) which have a predetermined depth and are formed along both side surfaces in a length direction of the mounting projection, and wherein the mounting groove (25) has hook projections which project by a predetermined width and are formed along both side surfaces in a length direction of the mounting groove so as to be fitting-inserted into the fitting groove (15A).

7. The frame assembly for a pistol with a lock lever according to claim 2, wherein the grip (11) has mounting portions (12) which have a predetermined depth at both side surfaces along a vertical length of the grip, and wherein the mounting portion (12) has a pair of grip panels (30) which are provided to be slid and fitting-assembled in a vertical direction.

8. The frame assembly for a pistol with a lock lever according to claim 2, wherein the lower frame (10) is manufactured in a single type or a double type depending on a size of a magazine which can be mounted inside the lower frame, wherein the upper frame (20) is manufactured to have a size of 4.25 in., 5 in., and 6 in. depending on a length of a gun barrel, and wherein the lower frame (10) as any one selected from the single type and the double type and the upper frame (20) as any one selected from upper frames of 4.25 in. 5 in. and 6 in. are configured to be assembled together.

* * * * *